US007636527B2

(12) United States Patent
Nanba et al.

(10) Patent No.: US 7,636,527 B2
(45) Date of Patent: Dec. 22, 2009

(54) FUSER APPARATUS, IMAGE FORMING APPARATUS INCLUDING THE FUSER APPARATUS, AND FUSER CONTROLLING METHOD

(75) Inventors: Toyoaki Nanba, Osaka (JP); Atsushi Ide, Nara (JP); Yoshinobu Tateishi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 612 days.

(21) Appl. No.: 11/561,915

(22) Filed: Nov. 21, 2006

(65) Prior Publication Data

US 2007/0134018 A1 Jun. 14, 2007

(30) Foreign Application Priority Data

Dec. 9, 2005 (JP) ..... 2005-356576

(51) Int. Cl.
*G03G 15/20* (2006.01)

(52) U.S. Cl. ..... 399/69; 399/67

(58) Field of Classification Search ..... 399/67, 399/69

See application file for complete search history.

(56) References Cited

U.S. PATENT DOCUMENTS

2003/0202814 A1* 10/2003 Senda et al. ..... 399/69
2006/0204266 A1* 9/2006 Watabe ..... 399/69
2007/0212091 A1* 9/2007 Kinouchi et al. ..... 399/69

FOREIGN PATENT DOCUMENTS

| | | |
|---|---|---|
| JP | 08-328425 | 12/1996 |
| JP | 2003-043852 | 2/2003 |
| JP | 2005-091867 | 4/2005 |

OTHER PUBLICATIONS

Japanese Office Action for corresponding application No. JP2005-356576 issued Jun. 2, 2009.

* cited by examiner

*Primary Examiner*—David M Gray
*Assistant Examiner*—Ryan D Walsh
(74) *Attorney, Agent, or Firm*—Renner, Otto, Boisselle & Sklar, LLP

(57) ABSTRACT

A fuser apparatus including: a fuser member having an endless contact surface to be brought into contact with each of successively transported recording media and a non-contact surface and being arranged to apply heat to the recording medium from the contact surface to fix a toner on the recording medium; a heating member energized to supply heat to the contact surface; a contact surface temperature detecting member for detecting a temperature of the contact surface; a non-contact surface temperature detecting member for detecting a temperature of the non-contact surface; and an energization controlling member for controling energization power of the heating member; wherein the energization controlling member controls the heating member energization power so that the heating member energization power is reduced as a difference between the non-contact surface temperature and the contact surface temperature decreases.

16 Claims, 8 Drawing Sheets

Tm,Ts
Te
S1
S2
200
180
160
100
Temperature (°C)
Start of printing
End of printing
0
100
Time (sec.)

40
20
0
Te-Tm(°C)
0
100
Time (sec.)

Main heater energization control duty ratio
100%
0%

Sub heater energization control duty ratio
100%
0%

Fuser roller driving signal
ON
OFF
0
100
Time (sec.)

Tm
200
180
160
100
Temperature (°C)
Upper limit fixing temperature
Predetermined fixing temperature
Lower limit fixing temperature
Roller rotation start temperature
End of warm-up
Start of warm-up
0
100
200
Time (sec.)

Main heater energization control signal
ON
OFF

Sub heater energization control signal
ON
OFF

Fuser roller driving signal
ON
OFF
0
100
200
Time (sec.)

Tm
Te
Ts
S3
S4
200
180
160
100
Temprature(°C)
Start of printing
End of printing
0
100
Time (sec.)

Main heater energization control duty ratio
100%
0%

Sub heater energization control duty ratio
100%
0%

Fuser roller driving signal
ON
OFF
0
100
Time (sec.)

FUSER APPARATUS, IMAGE FORMING APPARATUS INCLUDING THE FUSER APPARATUS, AND FUSER CONTROLLING METHOD

CROSS-REFERENCE TO RELATED APPLICATION

This application is related to Japanese application No. 2005-356576 filed on Dec. 9, 2005 whose priority is claimed under 35 USC §119, the disclosure of which is incorporated by reference in its entirety.

BACKGROUND OF THE INVENTION

1. Field of the Invention

The present invention relates to a fuser apparatus, an image forming apparatus including the fuser apparatus, and a fuser controlling method.

2. Description of the Related Art

Since the processing speeds of image forming apparatuses have been increased in recent years, it is imperative to improve the efficiency and service life of a fuser apparatus (fuser).

Such an image forming apparatus is generally supplied with electric power from a receptacle to which the apparatus is plugged in an office or the like. The receptacle has a limited power supply capacity. In Japan, for example, the receptacle has a rated voltage of 100V and a rated current of 15A. Therefore, the image forming apparatus should be designed so as to be operative under limited power supply conditions. On the other hand, the image forming apparatus is often required to have systematic and multifunctional capabilities and, therefore, includes peripheral devices such as an automatic document feeder (ADF), a finisher for stapling and punching, and a large capacity sheet cassette (LCC) provided in a main body thereof. These peripheral devices are also supplied with electric power from the same receptacle for their operations. Therefore, the fuser should be efficiently controlled for fixing a toner on a recording medium with the limited power supply.

Further, components of the fuser are liable to be degraded during use in a higher temperature environment and, therefore, replaced after their service lives. However, it is impermissible to shorten the cycle of the replacement of the components for increasing the processing speed of the image forming apparatus. Users demand to reduce downtime for the replacement of the components as well as to improve the efficiency of a high speed image forming apparatus. Further, the users demand to prolong the service lives of the components for reduction of maintenance costs. To meet these demands, it is necessary to improve materials for the components as well as to develop a fuser controlling method which suppresses the degradation of the components and prolongs the service lives of the components.

The fuser to be provided in the high speed image forming apparatus shares the power supply with the peripheral devices and, therefore, suffers from limitations of an office or domestic supply voltage and a breaker current capacity. The fuser needs a highly efficient heating method, i.e., a method for efficiently distributing power to a plurality of heat sources and quickly heating a heat roller and a press roller to predetermined temperatures.

In a conventional heat source energization controlling method, the power supply is steadily turned on (i.e., the power supply duty cycle is kept at 100%) until the surface temperatures of the heat roller and/or the press roller reach the predetermined fixing temperatures after a printing process is started. When the predetermined fixing temperatures are reached, the power supply is turned off (i.e., the power supply duty cycle is set at 0%). In this controlling method, the heat roller suffers from significant temperature overshoot in a standby state immediately after the end of the printing process. This reduces the service life of the heater roller (fuser roller). That is, the temperature overshoot significantly thermally deteriorates the roller, adversely affecting the durability of the roller.

One approach to the improvement of the efficiency of the fuser and the prolongation of the service lives of the components of the fuser is to suppress the temperature overshoot. A fuser member such as the heat roller for fixing the toner on the recording medium is controlled to be kept at the predetermined temperature. However, the temperature of the fuser member is actually fluctuated around a target temperature when the fuser member is heated by turning on and off a heater. That is, so-called "ripples" occur. Further, when recording media are successively transported to the fuser member, the recording media remove heat from the fuser member to reduce the temperature of the fuser member. Even if the heater is turned on upon detection of the temperature reduction of the fuser member, the fuser member suffers from a response delay because it has a heat capacity. Therefore, the temperature reduction continues for a while after the turn-on of the heater, and then the temperature of the fuser member starts increasing. The target temperature for the temperature control should be set at a level higher than a lower limit temperature at which the toner can be fixed after the temperature reduction.

During the fixation on the successively transported recording media, the heating of the heater is controlled so that the heat amount removed by the recording media and the heat amount supplied from the heater are balanced. Thus, the temperature of the fuser member can be kept around the target temperature. After the last recording medium is transported, no heat is removed from the fuser member. However, the temperature of the fuser member continues to increase due to the response delay attributable to the heat capacity of the fuser member, resulting in the temperature overshoot.

The fuser member should withstand a temperature change between the lower limit fixing temperature after the start of the fixing operation and the overshoot peak temperature after the end of the fixing operation. The range of the temperature change is a temperature ripple range during the fixing operation. During the fixing operation, it is tough for the components of the fuser member to withstand the temperature change in the high temperature range.

For easier understanding, a specific example of the fuser will be described. A typical type of the fuser is a roller fixing type. The roller fixing type fuser includes a fuser roller, a press roller, a heater disposed in the fuser roller, and a temperature sensor which detects the temperature of the peripheral surface of the fuser roller. The fuser roller applies heat to a recording medium for heating and fusing toner to fix the toner on the recording medium. The press roller and the fuser roller cooperatively hold the recording medium therebetween to transport the recording medium. The heater heats the surface of the fuser roller through heat conduction from the inside. Usable as the fuser roller is a roller including a metal core coated with a fluorine-containing resin for easier release of the toner, or a roller including a metal core coated with a rubber so as to have an elastic surface for increasing a nip width with respect to the press roller. If the contact surface temperature of the fuser roller is excessively increased due to the temperature overshoot, deterioration of the components of the roller is accelerated. In the worst case, the rubber coating is separated from the metal core due to the high temperature.

For example, the control target temperature is 180° C., and the lower limit temperature is 155° C. The overshoot peak temperature is 195° C., and a difference between the lower limit temperature and the peak temperature is 40° C.

A heater controlling method is known which suppresses the temperature overshoot after the end of the fixing operation (see, for example, Japanese Unexamined Patent Publication No. HEI8(1996)-328425). In the heater controlling method, after the lower limit temperature of the fuser roller is detected in the fixing operation, the heater is controlled so that a total heat amount to be applied to the fuser roller in a period between the detection of the lower limit temperature and the end of the fixing operation is reduced to a level smaller than a total heat amount to be applied to the fuser roller in a period between the start of the fixing operation and the detection of the lower limit temperature.

In the heater controlling method disclosed in the aforementioned patent publication, the heater is kept on in a period during which the roller contact surface temperature is reduced after the fixing operation is started by the start of a copying process, and turned on and off with a predetermined duty ratio after the roller contact surface temperature starts increasing. The patent publication states that the duty ratio may be determined according to the type of paper sheets, the rotation speed of the rollers, an inter-sheet distance and an ambient temperature around the apparatus, but discloses nothing about a specific method for determining the duty ratio.

As described above, the prolongation of the service life of the fuser roller and the improvement of the efficiency of the fuser can be achieved by suppressing the temperature overshoot of the fuser roller. However, it is difficult to eliminate the delay in the response to the detection of the temperature attributable to the heat capacity of the fuser roller. For suppression of the response delay, the heater may be controlled on the basis of a change in the detection temperature. Thus, the temperature overshoot is expected to be suppressed.

SUMMARY OF THE INVENTION

In view of the foregoing, the present invention is directed to the prolongation of the service life of the fuser roller and the improvement of the efficiency of the fuser by controlling the energization of the heating member for heating the fuser member to suppress the temperature overshoot.

The present invention provides (1) a fuser apparatus including: a fuser member having an endless contact surface to be brought into contact with each of successively transported recording media and a non-contact surface so as not to be brought into contact with the recording medium, the fuser member being arranged to apply heat to the recording medium from the contact surface to fix a toner on the recording medium; a heating member which is energized to supply heat to the contact surface; a contact surface temperature detecting member for detecting a temperature of the contact surface; a non-contact surface temperature detecting member for detecting a temperature of the non-contact surface which is increased by heat conduction from the contact surface; and an energization controlling member for controling energization power of the heating member; wherein, when the contact surface temperature rises toward a predetermined temperature, the energization controlling member controls the heating member energization power so that the heating member energization power is reduced as a difference between the non-contact surface temperature and the contact surface temperature decreases, (2) a fuser apparatus comprising: a fuser member having an endless contact surface to be brought into contact with each of successively transported recording media for applying heat to the recording medium from the contact surface to fix a toner on the recording medium; a heating member which is energized to heat the fuser member to supply heat to the contact surface; a contact surface temperature detecting member for detecting a temperature of the contact surface; and an energization controlling member which controls energization power of the heating member so that the detected contact surface temperature is equal to a predetermined temperature; wherein, when an amount of the heat supplied to the contact surface from the heating member is greater than an amount of the heat applied to the recording medium from the contact surface to increase the contact surface temperature toward the predetermined temperature, the energization controlling member controls the heating member energization power so that the heating member energization power is reduced as a difference between the predetermined temperature and the contact surface temperature decreases, and (3) an image forming apparatus including the aforementioned fuser apparatus in the item (1) or (2).

According to another aspect of the present invention, there is provided a fuser controlling method including steps for: using a fuser member having an endless contact surface to be brought into contact with each of successively transported recording media and a non-contact surface so as not to be brought into contact with the recording medium to apply heat to the recording medium from the contact surface to fix a toner on the recording medium; energizing a heating member to heat the fuser member to supply heat to the contact surface; detecting a temperature of the contact surface by a contact surface temperature detecting member; detecting a temperature of the non-contact surface by a non-contact surface temperature detecting member, the non-contact surface temperature being increased by heat conduction from the contact surface; and controlling energization power of the heating member by an energization controlling member so that the detected contact surface temperature is equal to a predetermined temperature; wherein, when an amount of the heat supplied to the contact surface from the heating member is greater than an amount of the heat applied to the recording medium from the contact surface to increase the contact surface temperature toward the predetermined temperature, the heating member energization power is controlled so as to be reduced as a difference between the non-contact surface temperature and the contact surface temperature decreases.

In the inventive fuser apparatus mentioned in the item (1), the energization controlling member controls the heating member energization power so that the heating member energization power is reduced as the difference between the non-contact surface temperature and the contact surface temperature decreases, when the amount of the heat supplied to the contact surface from the heating member is greater than the amount of the heat applied to the recording medium from the contact surface to increase the contact surface temperature toward the predetermined temperature. Therefore, it is possible to suppress the temperature overshoot after the contact surface temperature is increased to above the predetermined temperature.

Where the fuser member is heated upon detection of reduction of the contact surface temperature, there is a response delay due to the heat capacity of the fuser member. When the contact surface is supplied with a heat amount greater than the amount of the heat applied to the recording medium to compensate for the temperature reduction, the contact surface temperature is increased. However, even if the heating is stopped upon detection of the contact surface temperature reaching the predetermined temperature, the temperature overshoot occurs due to the response delay. According to the present invention, the heating member energization power is controlled so as to be reduced, as the difference between the non-contact surface temperature and the contact surface temperature decreases. Therefore, it is possible to suppress the overshoot after the contact surface temperature is increased to above the predetermined temperature.

DETAILED DESCRIPTION OF THE PREFERED EMBODIMENTS

Figures 1A, 1B, 1C, 1D, 1E:
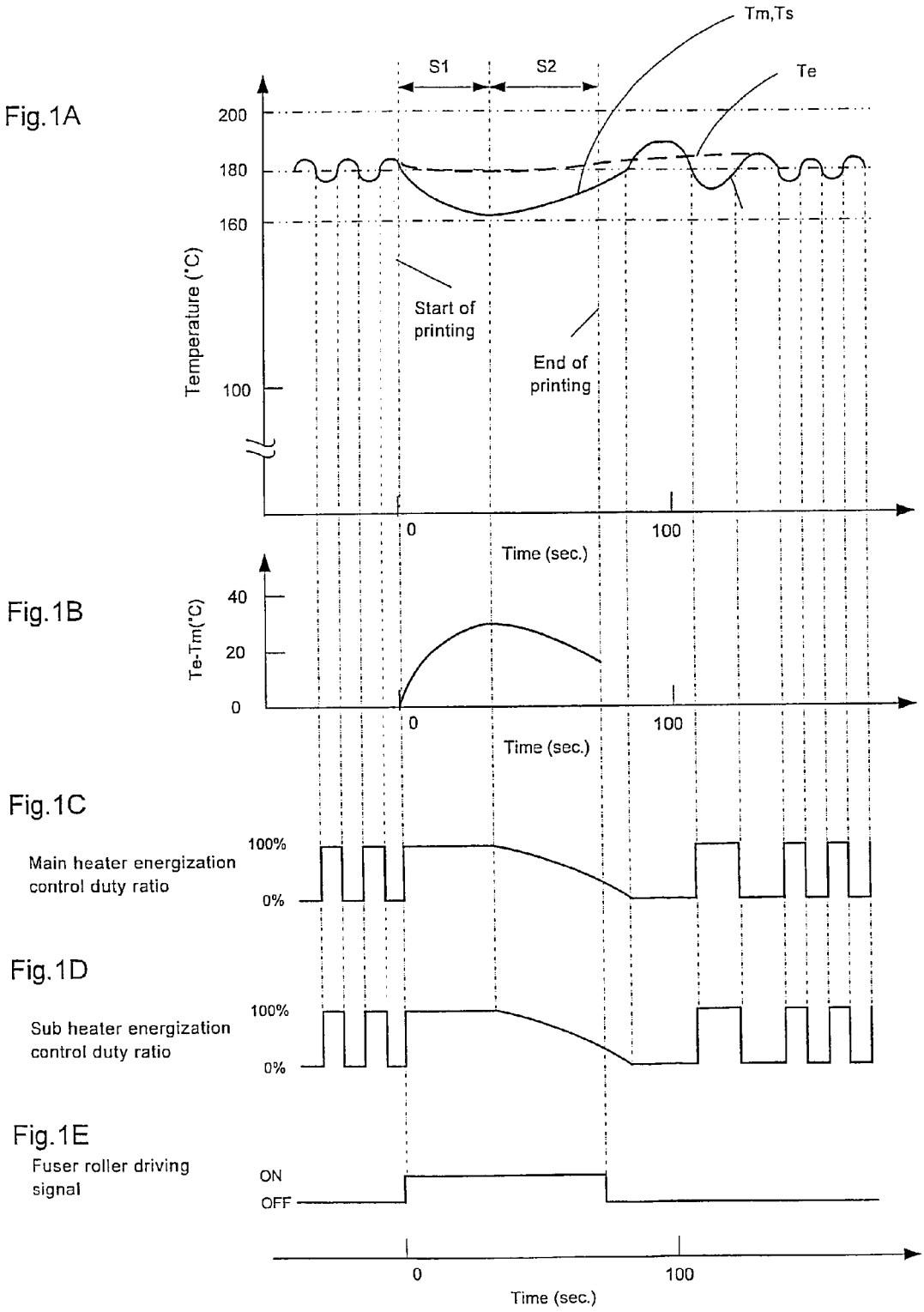
FIGS. 1A to 1E are graphs and timing charts for temperature control of an inventive fuser to be performed in a period during which a printing operation is sequentially performed on a plurality of sheets with the fuser being in a standby state before and after the printing operation.

In the aforementiond fuser apparatus mentioned in the item (1), the energization controlling member may control the energization power by turning on and off energization of the heating member and varying a ratio between an on-period and an off-period.

In the fuser apparatus, the fuser member may be a fuser roller. Alternatively, the fuser member may be a fuser belt.

In the fuser apparatus, the heating member may be a heater disposed in generally center portion of an axis of a fuser roller serving as the fuser member. Alternatively, the heating member may be a heater disposed in opposed relation to a surface of the fuser belt for heating the fuser belt, or a heater disposed in a fuser belt driving roller for heating the fuser belt via the roller.

In the fuser apparatus, the fuser member may be a fuser roller which has a peripheral surface having a greater width than a width of the recording medium in the axis direction, the contact surface may be a generally axially middle portion of the peripheral surface to be brought into contact with the recording medium, and the contact surface temperature detecting member ma be at least partly disposed in opposed relation to or in contact with the contact surface. Alternatively, the fuser member may be a fuser belt which has a peripheral surface having an axial length greater than the width of the recording medium. In this case, the contact surface is a generally axially middle portion of the peripheral surface to be brought into contact with the recording medium, and the contact surface temperature detecting member is at least partly disposed in opposed relation to or in contact with the contact surface.

In the fuser apparatus, the fuser member may be a fuser roller which has a peripheral surface having an axial length greater than a width of the recording medium, the non-contact surface may be a portion of the peripheral surface excluding a generally axially middle portion of the peripheral surface to be brought into contact with the recording medium, and the non-contact surface temperature detecting member may be at least partly disposed in opposed relation to or in contact with the non-contact surface. Alternatively, the fuser member may be a fuser belt which has a peripheral surface having an axial length greater than the width of the recording medium. In this case, the non-contact surface is a portion of the peripheral surface excluding a generally axially middle portion of the peripheral surface to be brought into contact with the recording medium, and the non-contact surface temperature detecting member is at least partly disposed in opposed relation to or in contact with the non-contact surface.

Further, the contact surface temperature detecting member may be disposed in opposed relation to the contact surface, and the non-contact surface temperature detecting member may be disposed in contact with the non-contact surface.

In the aforementioned fuser apparatus in (2), the energization controlling member controls the heating member energization power so that the heating member energization power is reduced as the difference between the predetermined temperature and the contact surface temperature decreases, when the amount of the heat supplied to the contact surface from the heating member is greater than the amount of the heat applied to the recording medium from the contact surface to increase the contact surface temperature toward the predetermined temperature. Therefore, it is possible to suppress the overshoot after the contact surface temperature is increased to above the predetermined temperature.

The present invention will hereinafter be described in greater detail with reference to the attached drawings. The invention will be best understood from the following description. It should be understood that the following description is illustrative of the invention in all aspects, but not limitative of the invention.

Overall Operation of Image Forming Apparatus

Figure 3:
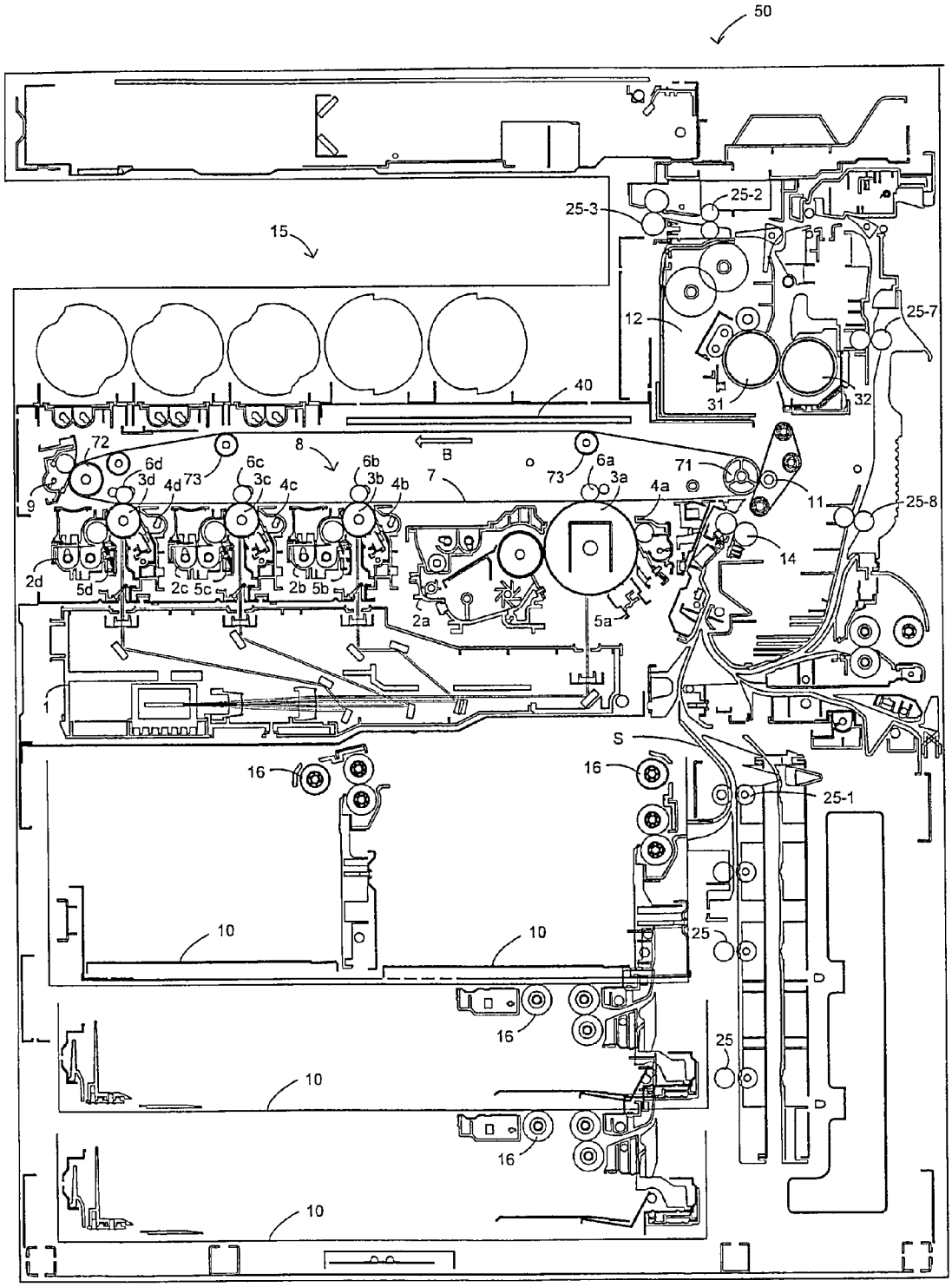
FIG. 3 is an explanatory diagram illustrating the construction of an image forming apparatus according to the present invention by way of example.

FIG. 3 is an explanatory diagram illustrating the construction of an image forming apparatus according to the present invention. The image forming apparatus 50 is adapted to form a multicolor image or a monochrome image on a sheet (recording medium) on the basis of image data transmitted from the outside. As shown in FIG. 3, the image forming apparatus 50 includes an exposure unit 1, four developers 2 (2*a*, 2*b*, 2*c*, 2*d*), four photoconductor drums 3 (3*a*, 3*b*, 3*c*, 3*d*), four chargers 5 (5*a*, 5*b*, 5*c*, 5*d*), four cleaner units 4 (4*a*, 4*b*, 4*c*, 4*d*), an intermediate transfer belt unit 8, a fuser unit 12, a sheet transport path S, sheet feeding trays 10, and a sheet exit tray 15.

The image data to be processed by the image forming apparatus 50 include color image data for black (K), cyan (C), magenta (M) and yellow (Y). Therefore, the four developers 2 (2*a*, 2*b*, 2*c*, 2*d*), the four photoconductor drums 3 (3*a*, 3*b*, 3*c*, 3*d*), the four chargers 5 (5*a*, 5*b*, 5*c*, 5*d*) and the four cleaner units 4 (4*a*, 4*b*, 4*c*, 4*d*) serve for formation of four latent images for the respective colors. Characters a, b, c, d suffixed to the reference characters herein correspond to black, cyan, magenta and yellow, respectively. Four image forming stations are provided for the four colors.

The photoconductor drums 3 are disposed in an upper portion of the image forming apparatus 50. The chargers 5 are charging means for uniformly charging surfaces of the photoconductor drums 3 at a predetermined potential. Electric discharge type chargers as shown in FIG. 3, or contact roller type or contact brush type chargers may be used as the chargers 5. The exposure unit 1 shown in FIG. 3 is a laser scanning unit (LSU) including a laser emitting section and reflection mirrors. Alternatively, the exposure unit 1 may include an EL or LED writing head which includes light emitting elements arranged in an array. The exposure unit 1 serves to expose the electrically charged photoconductor drums 3 on the basis of the inputted image data to form electrostatic latent images on the surfaces of the respective photoconductor drums 3. The developers 2 serve to develop the electrostatic latent images formed on the respective photoconductor drums 3 into toner images with color toners (K, C, M, Y). The cleaner units 4 serve to remove and recover toners remaining on the surfaces of the photoconductor drums 3 after the development and transfer of the toner images.

The intermediate transfer belt unit 8 is disposed above the photoconductor drums 3, and includes an intermediate transfer belt 7, an intermediate transfer belt driving roller 71, an intermediate transfer belt tension mechanism 73, an intermediate transfer belt driven roller 72, intermediate transfer rollers 6 (6*a*, 6*b*, 6*c*, 6*d*) and an intermediate transfer belt cleaning unit 9.

The intermediate transfer belt 7 is stretched around the intermediate transfer belt driving roller 71, rollers of the intermediate transfer tension mechanism 73, the intermediate transfer rollers 6 and the intermediate transfer belt driven roller 72, and driven to be rotated in an arrow direction B.

In the intermediate transfer belt unit 8, the intermediate transfer rollers 6 are rotatably supported by intermediate transfer roller attachment portions of the intermediate transfer belt tension mechanism 73, and serve to apply transfer biases for transferring the toner images from the photoconductor drums 3 to the intermediate transfer belt 7.

The intermediate transfer belt 7 is disposed in contact with the respective photoconductor drums 3. The intermediate transfer belt 7 functions to receive the toner images of the respective colors successively transferred thereto from the respective photoconductor drums 3 in superposed relation, whereby a color toner image (multicolor toner image) is formed on the intermediate transfer belt 7. The intermediate transfer belt 7 is an endless belt formed of a film having a thickness of about 100 μm to about 150 μm.

The transfer of the toner images from the photoconductor drums 3 to the intermediate transfer belt 7 is achieved by the intermediate transfer rollers 6 disposed in contact with a rear side of the intermediate transfer belt 7. High-voltage transfer biases (having a polarity (+) opposite to the polarity of a toner charge (−)) are respectively applied to the intermediate transfer rollers 6 for the transfer of the toner images. The intermediate transfer rollers 6 each include a metal shaft (such as of stainless steel) having a diameter of 8 mm to 10 mm and an electrically conductive elastic surface layer (of an elastomer such as EPDM or polyurethane foam). The electrically conductive elastic surface layer makes it possible to uniformly apply the high voltage to the intermediate transfer belt 7. In this embodiment, roller-shaped transfer electrodes are used, but other types of transfer electrodes such as brush-shaped transfer electrodes may be used.

The toner images of the respective colors formed by developing the electrostatic latent images on the respective photoconductor drums 3 are superposed on the intermediate transfer belt 7. The resulting multicolor image corresponds to image information inputted to the apparatus. The multicolor image is transferred onto a sheet by a transfer roller 11 disposed in contact with the intermediate transfer belt 7 with the intervention of the sheet.

At this time, the transfer roller 11 is pressed against the intermediate transfer belt 7 with a predetermined nip. A high voltage (having a polarity (+) opposite to the polarity (−) of the toner charge) is applied to the transfer roller 11 for transferring the multicolor toner image onto the sheet. To steadily provide the nip between the transfer roller 11 and the intermediate transfer belt 7, one of the transfer roller 11 and the intermediate transfer belt driving roller 71 is a hard roller composed of a hard material (e.g., a metal roller), and the other is an elastic roller composed of a soft material (e.g., an elastic rubber roller or a foamed resin roller).

As described above, the toner adhering to the intermediate transfer belt 7 due to the contact with the photoconductor drums 3 or remaining on the intermediate transfer belt 7 without being transferred onto the sheet by the transfer roller 11 is removed and recovered by the intermediate transfer belt cleaning unit 9. The intermediate transfer belt cleaning unit 9 includes a cleaning blade serving as a cleaning member to be brought into contact with the intermediate transfer belt 7. A portion of the intermediate transfer belt 7 to be brought into contact with the cleaning blade is supported by the intermediate transfer belt driven roller 72 from a back side.

The sheet feeding trays 10 are each adapted to store sheets (recording media) to be used for the image formation. The sheet feeding trays 10 are disposed below the image forming stations and the exposure unit 1 of the image forming apparatus 50. The sheet exit tray 15 is disposed on the image forming apparatus 50, and serves to receive printed sheets with their faces down.

The image forming apparatus 50 includes a sheet transport path S extending generally vertically for transporting a sheet from the sheet feeding trays 10 to the sheet exit tray 15 through the transfer section 11 and the fuser unit 12. Further, pickup rollers 16, registration rollers 14, the transfer section 11, the fuser unit 12 and transport rollers 25 are disposed along the sheet transport path S extending from the sheet feeding trays 10 to the sheet exit tray 15.

The transport rollers 25 are smaller size rollers for promoting and assisting the transport of the sheet. The transport rollers 25 are disposed along the sheet transport path S. The pickup rollers 16 are disposed on edges of the respective sheet feeding trays 10 for introducing a sheet from the sheet feeding trays 10 into the sheet transport path S.

The registration rollers 14 serve to once stop the sheet transported through the sheet transport path S and then transport the sheet at timing such as to register a leading edge of the multicolor toner image on the intermediate transfer belt 7 with a leading edge of the sheet.

The fuser unit 12 includes a heat roller 31, a press roller 32 and the like. The heat roller 31 and the press roller 32 are rotated with the sheet held therebetween.

The heat roller 31 is controlled at a predetermined fixing temperature by a control section on the basis of a signal from a temperature detector not shown. The heat roller 31 cooperates with the press roller 32 for heat-pressing the sheet. Thus, the multicolor toner image transferred onto the sheet is fused and pressed on the sheet to be thereby thermally fixed on the sheet.

The sheet on which the multicolor toner image is fixed is transported into a reverse sheet exit path of the sheet transport path S by a transport roller 25, and discharged onto the sheet exit tray 15 in a reversed state (with a multicolor toner image surface thereof facing down).

Next, the sheet transport path S will be described in detail. The sheet feeding trays 10 (sheet cassettes) in which the sheets are stacked are preliminarily mounted in the image forming apparatus.

The pickup rollers 16 are respectively disposed on the edges of the sheet feeding trays 10 for introducing the sheets one by one into the sheet transport path S.

The sheet fed out of one of the sheet cassettes 10 is transported to the registration rollers 14 by a transport roller 25-1 in the transport path, and further transported to the transfer roller 11 with the leading edge of the sheet being registered with the leading edge of the multicolor toner image on the intermediate transfer belt 7, whereby the multicolor toner image is transferred onto the sheet. Thereafter, the sheet is passed through the fuser unit 12, whereby unfixed toner on the sheet is fused and solidified. Then, the resulting sheet is transported by transport rollers 25-2, and discharged onto the sheet exit tray 15 by sheet exit rollers 25-3.

Where a printing operation is requested to be performed in a double-side printing mode, a trailing edge of the sheet subjected to the printing operation on a front side thereof and passed through the fuser unit 12 is held between the sheet exit rollers 25-3. When the sheet exit rollers 25-3 are rotated reverse, the sheet is transported to transport rollers 25-7, 25-8 and then to the registration rollers 14. Then, the printing operation is performed on a rear side of the sheet, and the resulting sheet is discharged onto the sheet exit tray 15.

A control board 40 is disposed below the sheet exit tray 15. The control board 40 includes a microprocessor for controlling operations of the respective components of the image forming apparatus 50, a ROM and a RAM. The ROM stores control programs to be performed by the microprocessor. The RAM provides a work area and an image data storing area to be used by the microprocessor for processing. Control for a fixing operation to be described later is performed by the microprocessor by executing a control program stored in the ROM. Further, the control board includes an input circuit and an output circuit. Signals from sensors and thermistors 85 and 95 which detect the temperatures of the heat roller 31 and the press roller 32 are inputted to the input circuit. The microprocessor performs processing operations by using these signals. The output circuit is adapted to perform load driving operations on the respective components, for example, to perform switching operations for energization of heaters for heating the heat roller 31 and the press roller 32.

Fuser Unit

Figure 4:
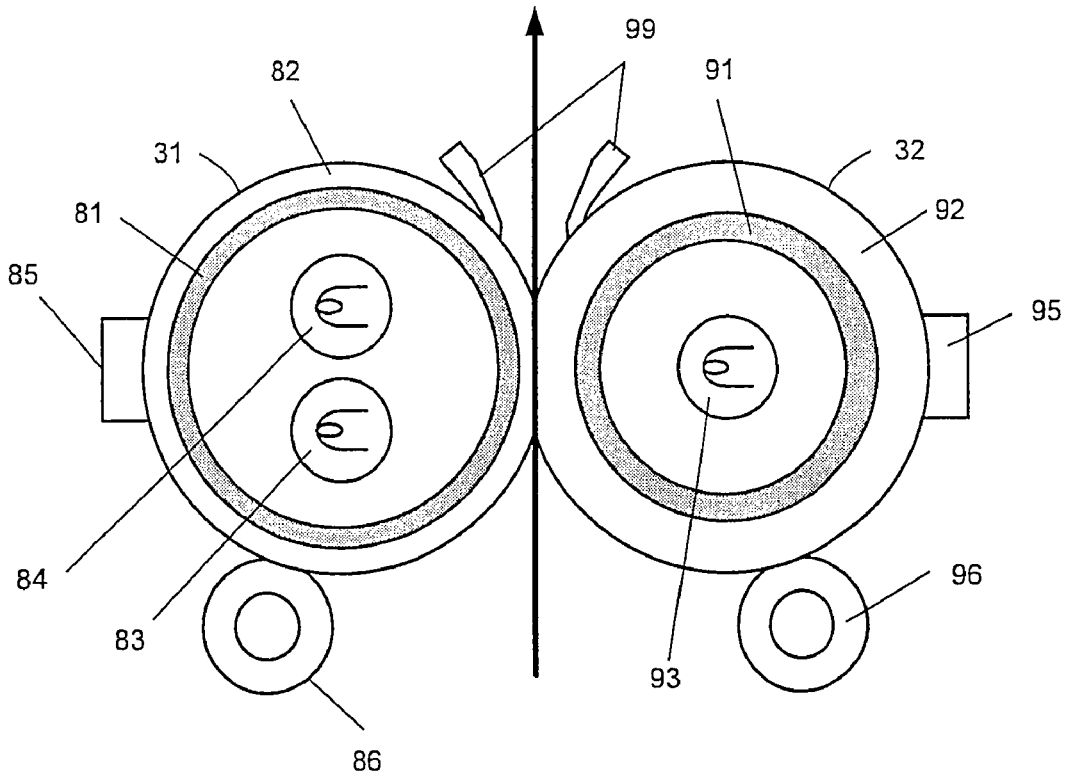
FIG. 4 is a sectional view illustrating the layout of major components of a fuser unit 12 taken along a sheet transport direction in FIG. 3.
Figure 5:
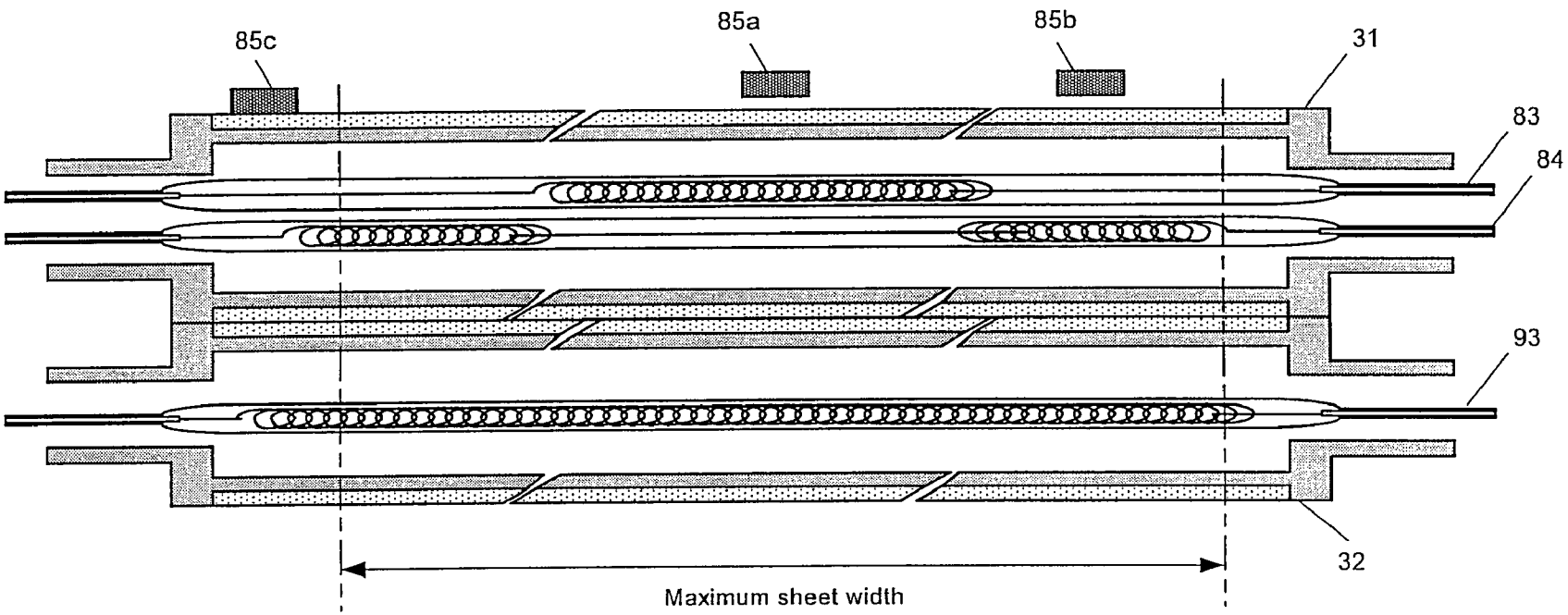
FIG. 5 is a sectional view taken along a plane containing axes of a heater roller 31 and a press roller 32 of the fuser unit 12 in FIG. 3.

FIG. 4 is a sectional view illustrating the layout of major components of the fuser unit 12 taken along the sheet transport direction in FIG. 3. In FIG. 4, an arrow indicates how the sheet is transported. The heat roller 31 and the press roller 32 are driven by a drive mechanism not shown so as to transport the sheet in the arrow direction. FIG. 5 is a sectional view taken along a plane containing axes of the heater roller 31 and the press roller 32 of the fuser unit 12 of FIG. 3. As shown in FIG. 4, the heat roller 31 includes a cylindrical metal core 81 and a silicone rubber layer 82 provided around the metal core 81, and a main heater 83 and a sub heater 84 are provided in the metal core 81 for heating the heat roller 31. As shown in FIG. 5, the main heater 83 heats a generally middle portion of the heat roller 31, while the sub heater 84 heats portions of the heat roller 31 on laterally opposite sides of the generally middle portion heated by the main heater 83.

The heat roller 31 is heated by the two types of heaters, i.e., the main heater 83 and the sub heater 84, for the following reason. Where a maximum sheet passage width is equivalent to the length of an A4-size sheet to be laterally fed (or the width of an A3-size sheet to be longitudinally fed), for example, both the main heater 83 and the sub heater 84 are used to heat the surface of the heat roller 31, so that heat to be removed by the sheet can be supplied. However, where smaller width sheets are sequentially fed, e.g., A4-size sheets are sequentially fed longitudinally or A5-size sheets are sequentially fed laterally, only the main heater 83 is used to heat the surface of the heat roller 31. This is because greater heat is removed from a middle surface portion of the heat roller 31 by the passage of the sheets and a temperature difference between the middle portion and portions of the heat roller 31 outside the sheet width is increased by the passage of the sheets. Thus, unwanted temperature increase of the outside portions of the heat roller 31 is suppressed. As described above, if the temperature of the heat roller 31 is excessively increased, the excessively heated portions of the heat roller 31 are degraded. This reduces the service life of the heat roller 31, or causes the silicone rubber surface layer 82 to be separated from the metal core 81.

The temperature unbalance is remarkable particularly in the case of an image forming apparatus having a higher printing speed. Where the printing speed is higher, the number of sheets passed over the heat roller 31 per unit time, i.e., the amount of the heat removed from the surface of the heat roller 31 per unit time, is greater than where the printing speed is lower. Therefore, it is impossible to provide a uniform surface temperature distribution by heat conduction from the outside portions of the heat roller 31.

Thermistors 85 (85*a*, 85*b*, 85*c*) for detecting surface temperatures of the heat roller 31 is disposed in association with the surface of the heat roller 31. More specifically, as shown in FIG. 5, the thermistors 85 include a non-contact main heater control thermistor 85*a* for detecting the surface temperature of the generally middle portion heated by the main heater 83, and a non-contact sub heater control thermistor 85*b* for detecting the surface temperature of the outside portion heated by the sub heater 84. Further, a contact thermistor 85*c* is disposed in contact with an end portion of the surface of the heat roller 31 outside the maximum sheet passage width. The thermistor 85*c* detects overheat of the end portion (sheet non-passage area) of the heat roller 31 heated by heat conduction from the portions heated by the sub heater 84 for protection of the heat roller 31.

The thermistors 85*a*, 85*b* which detect the temperatures of a sheet passage area of the heat roller 31 are preferably of non-contact type for prevention of contamination thereof with toner and dirt transferred from the sheet to the surface of the heat roller 31. On the other hand, the thermistor 85*c* which detects the temperature of the sheet non-passage area of the heat roller 31 is preferably of contact type which is simple and less expensive.

A cleaning roller 86 is provided in contact with the surface of the heat roller 31 for removing toner and dirt adhering to the heat roller 31. Further, a cleaning roller 96 is provided in contact with the press roller 32 for removing dirt adhering to the surface of the press roller 32. The cleaning rollers 86, 96 each include a metal core around which a nonwoven fabric is wrapped.

Sheet separation claws 99 are disposed downstream of the nip between the heat roller 31 and the press roller 32. The sheet separation claws 99 respectively have a claw tip abutting against the heat roller 31 and a claw tip abutting against the press roller 32. Where the leading edge of the sheet passing through the nip adheres to the heat roller 31 or the press roller 32, the sheet is mechanically separated from the roller by the claw tip.

Fixing Control

Temperature control of the fuser will hereinafter be described in greater detail. The temperature control is performed by the microprocessor by executing control programs.

[Control for Warm-Up]

Figures 6A, 6B, 6C, 6D:
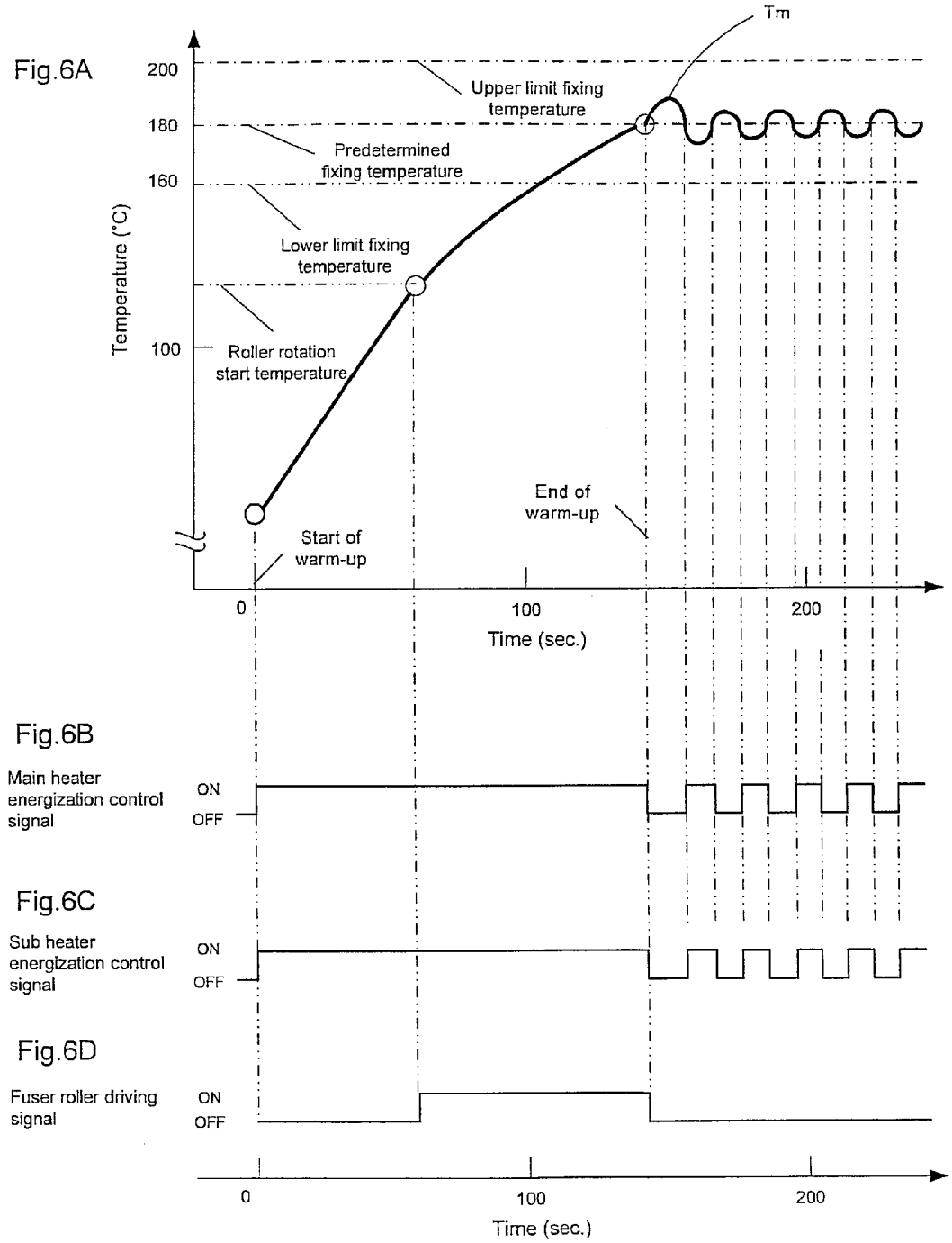
FIGS. 6A to 6D are a graph and timing charts for temperature control in which the surface temperature of the heat roller 31 is increased to a predetermined fixing temperature after start of a warm-up operation and then is controlled around the predetermined temperature in the standby state in the apparatus of FIG. 3.

FIGS. 6A to 6D are a graph and timing charts for temperature control in which the surface temperature of the heat roller 31 is increased to a predetermined fixing temperature (180° C.) after start of a warm-up operation and then controlled around the predetermined temperature in the standby state in the apparatus of FIG. 3. Particularly, FIG. 6A illustrates a change in the temperature detected by the main heater control thermistor 85*a*. FIG. 6B illustrates an energization control signal to be applied to the main heater 83, and FIG. 6C illustrates an energization control signal to be applied to the sub heater 84. FIG. 6D illustrates a drive signal to be applied to the rollers of the fuser.

The microprocessor controls the main heater 83 and the sub heater 84 on the basis of a detection temperature Tm of the main heater control thermistor 85*a* in a warm-up period and in a standby period. Energization control operations to be performed on the main heater 83 and the sub heater 84 coincide with each other.

At the start of the warm-up operation, the detection temperature Tm is around a room temperature below the predetermined fixing temperature. The microprocessor switches on the main heater energization control signal and the sub heater energization control signal to heat the heat roller 31. By the heating, the detection temperature Tm increases to reach a roller rotation start temperature. The microprocessor switches on the fuser roller drive signal to rotate the heat roller 31. When the detection temperature Tm increases to reach the predetermined fixing temperature, the microprocessor stops the driving of the rollers of the fuser, and switches off the energization of the main heater 83 and the sub heater 84.

When the detection temperature Tm thereafter decreases to below the predetermined fixing temperature in the standby period, the energization of the main heater 83 and the sub heater 84 is switched on. On the other hand, when the detection temperature Tm increases to above the predetermined fixing temperature, the energization of the main heater 83 and the sub heater 84 is switched off. The detection temperature increases and decreases with a delay in response to the switch on and off of the heaters due to the heat capacity of the heat roller 31.

The temperature control of the sub heater 84 may be performed independently of the temperature control of the main heater 83 in the warm-up period. That is, the energization control of the sub heater 84 may be based on the detection temperature of the sub heater control thermistor 85*b*.

[Control for Sequential Printing Operation]

FIGS. 1A to 1E are graphs and timing charts for temperature control of the inventive fuser to be performed in a period during which a printing operation is sequentially performed on a plurality of sheets with the fuser being in the standby state before and after the printing operation. Particularly, FIG. 1A illustrates changes in temperatures Tm, Ts and Te respectively detected by the main heater control thermistor 85*a*, the sub heater control thermistor 85*b* and the sheet non-passage area thermistor 85*c*. FIG. 1B illustrates a change in a difference between the detection temperatures Te and Tm in the printing operation. FIG. 1C illustrates the duty ratio of the energization control signal to be applied to the main heater 83, and FIG. 1D illustrates the duty ratio of the energization control signal to be applied to the sub heater 84. FIG. 1E illustrates a drive signal to be applied to the rollers of the fuser.

In FIGS. 1A to 1E, it is assumed that an A4-size sheet is transported laterally (with its longer edges being perpendicular to the transport direction) and passes over the maximum width sheet passage area of the heat roller 31. In this case, the microprocessor controls the energization of the main heater 83 on the basis of a difference between the detection temperature Te and the detection temperature Tm, and controls the energization of the sub heater 84 on the basis of a difference between the detection temperature Te and the detection temperature Ts. In FIG. 1A, the detection temperatures Tm and Ts are illustrated as coinciding with each other for simplification of the graph, but may differ from each other.

In the printing operation, the microprocessor controls the energization of the main heater 83 on the basis of the predetermined fixing temperature, the detection temperature Tm of the main heater control thermistor 85*a* and the detection temperature Te of the sheet non-passage area thermistor 85*c*, and controls the energization of the sub heater 84 on the basis of the predetermined fixing temperature, the detection temperature Ts of the sub heater control thermistor 85*b* and the detection temperature Te of the sheet non-passage area thermistor 85*c*. Since the energization of the sub heater 84 is controlled in substantially the same manner as the energization of the main heater 83, explanation will be given only to the energization control of the main heater 83 below.

Upon the start of the printing operation, the heat is removed by the sheet, so that the detection temperature Tm decreases. In a period S1 during which the temperature Tm decreases due to the passage of the sheet, the microprocessor controls the main heater 83 with an energization duty ratio of 100%. That is, the main heater 83 is steadily energized. The heat supplied from the main heater 83 is conducted to the sheet passage surface area of the heat roller 31, whereby the detection temperature Tm starts increasing. Thereafter, the amount of the heat supplied by the heating is greater than the amount of the heat removed due to the passage of the sheet, so that the detection temperature Tm continues to increase in a period S2.

In the period S2 during which the detection temperature Tm increases, the microprocessor controls the energization duty ratio of the main heater 83 on the basis of the difference between the detection temperature Te and the detection temperature Tm.

Upon completion of the printing operation, no heat is removed from the heat roller 31 without the passage of the sheet. However, the detection temperature Tm is still lower than the predetermined fixing temperature, so that the energization of the main heater 83 is continued. In this embodiment, energization power of the main heater 83 is reduced as the detection temperature Tm approaches the detection temperature Te of the sheet non-passage area. Therefore, the temperature overshoot after the end of the printing operation can be suppressed which may otherwise occur due to heat excessively accumulated in the heat roller 31. That is, the first peak of the detection temperature Tm after the end of the printing operation is minimized.

Figure 2:
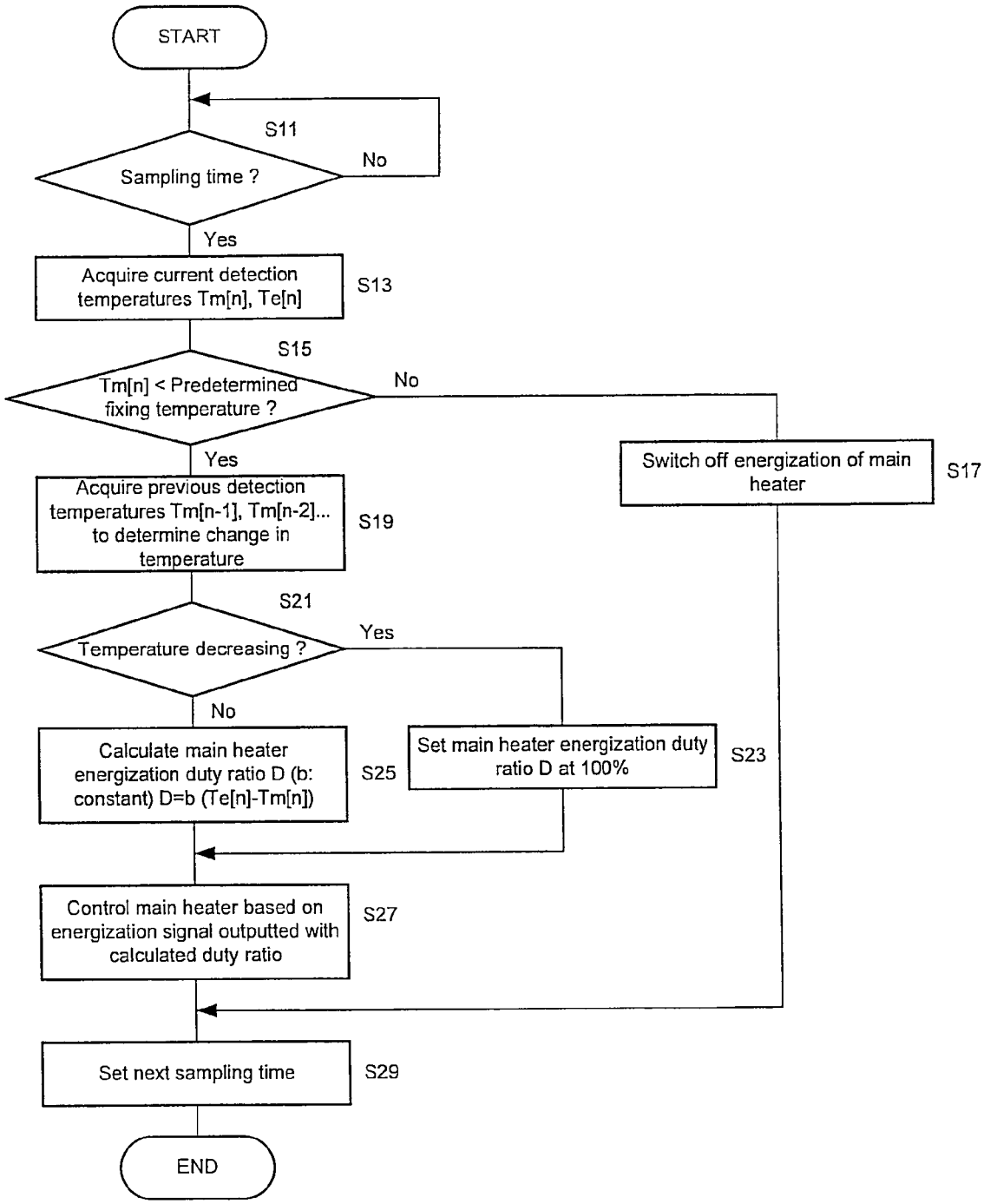
FIG. 2 is a flow chart for a fixing temperature control process to be performed by a microprocessor in the inventive fuser during the printing operation.

FIG. 2 is a flow chart for a fixing temperature control process to be performed by the microprocessor in the inventive fuser during the printing operation. The process shown in FIG. 2 is repeated at every sampling time. The sampling interval may be constant, or may be varied.

As shown in FIG. 2, the microprocessor waits for predetermined sampling time (Step S11), and acquires current detection temperatures Tm[n] and Te[n] (Step S13). The acquired detection temperature Tm[n] is also used at subsequent sampling time and, therefore, stored in a FIFO buffer. Here, [n] means current sampling time. Then, the microprocessor judges whether the acquired detection temperature Tm[n] is lower than the predetermined fixing temperature (Step S15). If the detection temperature Tm[n] is not lower than the fixing temperature, the microprocessor switches off the energization of the main heater 83 (Step S17), and goes to Step S29.

On the other hand, if the acquired detection temperature Tm[n] is lower than the predetermined fixing temperature, the microprocessor judges, with reference to the previous detection temperatures Tm[n-1], Tm[n-2] . . . , whether the temperature is decreasing (Step S19). Here, the number of the previous detection temperatures to be referred to is determined so that ripples and noises occurring in a short cycle can be eliminated for accurate judgment of the change in the temperature.

If it is judged that the detection temperature Tm is decreasing, the microprocessor sets the main heater energization duty ratio at 100% (Step S23), and controls the energization of the main heater 83 with the set duty ratio (Step S27). On the other hand, if it is judged in Step S21 that the temperature is not decreasing, the microprocessor determines the main heater energization duty ratio from the following expression (Step S25):

$$D=bx(Te[n]-Tm[n]) \quad (1)$$

wherein D is the energization duty ratio and b is a constant.

According to the expression (1), the energization duty ratio is reduced, as the detection temperature Tm[n] approaches the detection temperature Te[n]. If the detection temperature Tm[n] is equal to the detection temperature Te[n], the energization duty ratio is set at 0%, i.e., the energization is switched off. This means that the duty ratio for the energization of the heater which heats the sheet passage area of the heat roller 31 is reduced as the surface temperature of the sheet passage area of the heat roller 31 (corresponding to Tm[n]) approaches the surface temperature of the end portion of the heat roller 31 (corresponding to Te[n]).

However, the expression on which the determination of the heater energization duty ratio is based is not limited to the expression (1). For example, the energization duty ratio may be determined further based on a change in the difference between the detection temperature Te[n] and the detection temperature Tm[n]. Alternatively, the determination of the energization duty ratio may be based on a quadratic expression of the detection temperature Te[n] and the detection temperature Tm[n], or may be based on a data table which cannot be represented by a simple arithmetic expression.

The microprocessor controls the energization of the main heater 83 with the energization duty ratio determined from the expression (1) (Step S27).

Thereafter, the microprocessor determines the next sampling time (Step S29), and ends the process.

FIGS. 7A to 7D are a graph and timing charts for temperature control different from that shown in FIGS. 1A to 1E, illustrating changes in the temperatures of the heat roller 31. In the control shown in FIGS. 1A to 1E, the microprocessor controls the main heater energization duty ratio on the basis of the difference between the detection temperature Tm[n] and the predetermined fixing temperature in the period S2 during which the detection temperature Tm is lower than the predetermined fixing temperature and increases even with the passage of the sheet in the printing operation. On the other hand, in the control shown in FIGS. 7A to 7D, the microprocessor controls the main heater energization duty ratio on the basis of a difference between the detection temperature Te of the sheet non-passage area thermistor 85*c* and the detection temperature Tm.

Figures 7A, 7B, 7C, 7D:
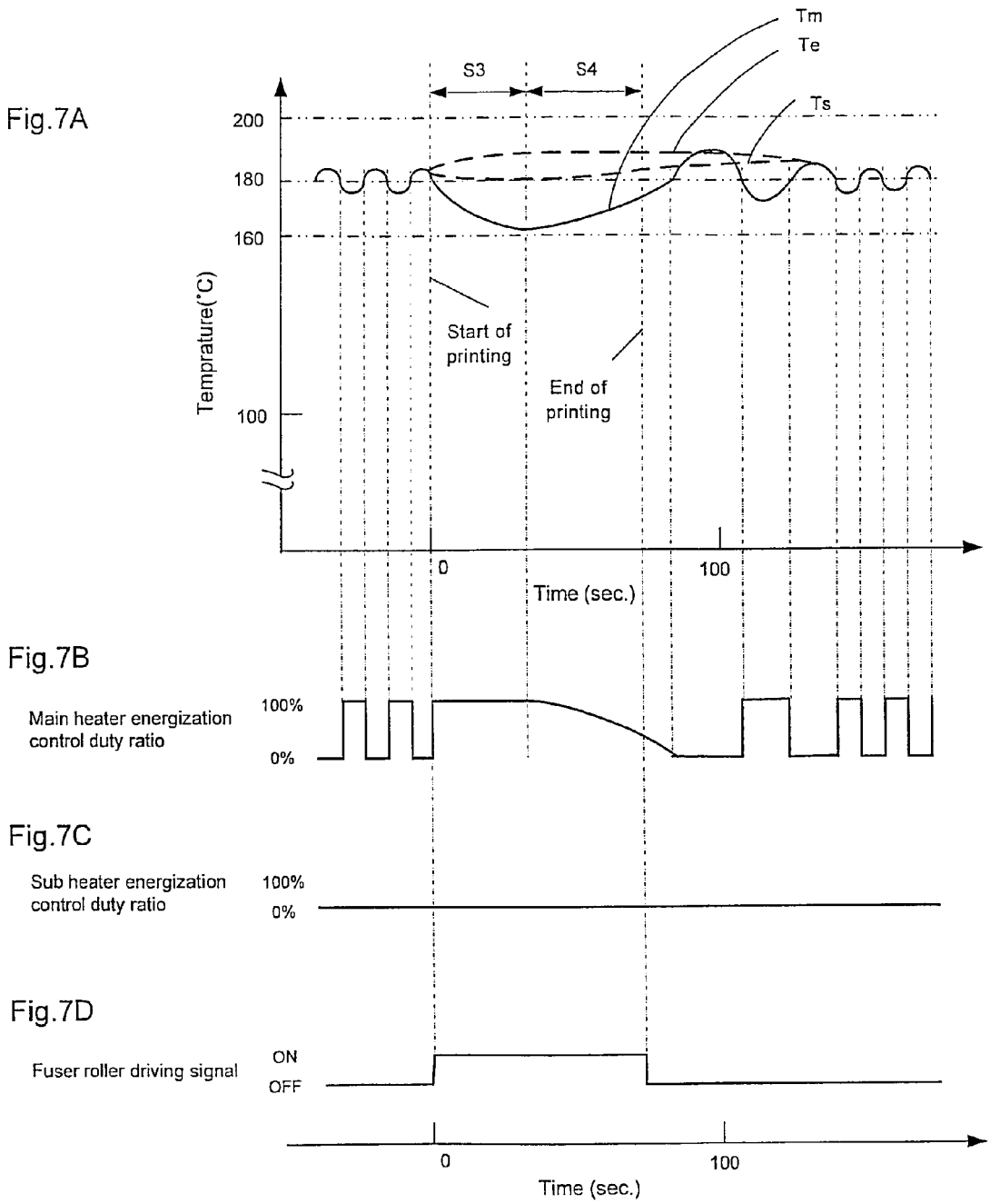
FIGS. 7A to 7D are a graph and timing charts for temperature control different from that shown in FIGS. 1A to 1E, illustrating changes in the temperatures of the heat roller 31.

FIG. 7A is a graph which illustrates the changes in the temperatures Tm, Ts and Te respectively detected by the main heater control thermistor 85*a*, the sub heater control thermistor 85*b* and the sheet non-passage area thermistor 85*c*. FIG. 7B illustrates the duty ratio of a control signal for energization of the main heater 83, and FIG. 7C illustrates the duty ratio of a control signal for energization of the sub heater 84. FIG. 7D illustrates a drive signal to be applied to the rollers of the fuser.

In the control according to FIGS. 7A to 7D, it is assumed that an A5-size sheet which is smaller in maximum sheet width than the A4-size sheet is transported laterally to pass over the heat roller 31. In FIG. 7A, a solid line indicates a change in the detection temperature Tm of the main heater control thermistor 85*a*. A lower broken line indicates a change in the detection temperature Ts of the sub heater control thermistor 85*b*, and an upper broken line indicates a change in the detection temperature Te of the sheet non-passage area thermistor 85*c*.

Figure 8:
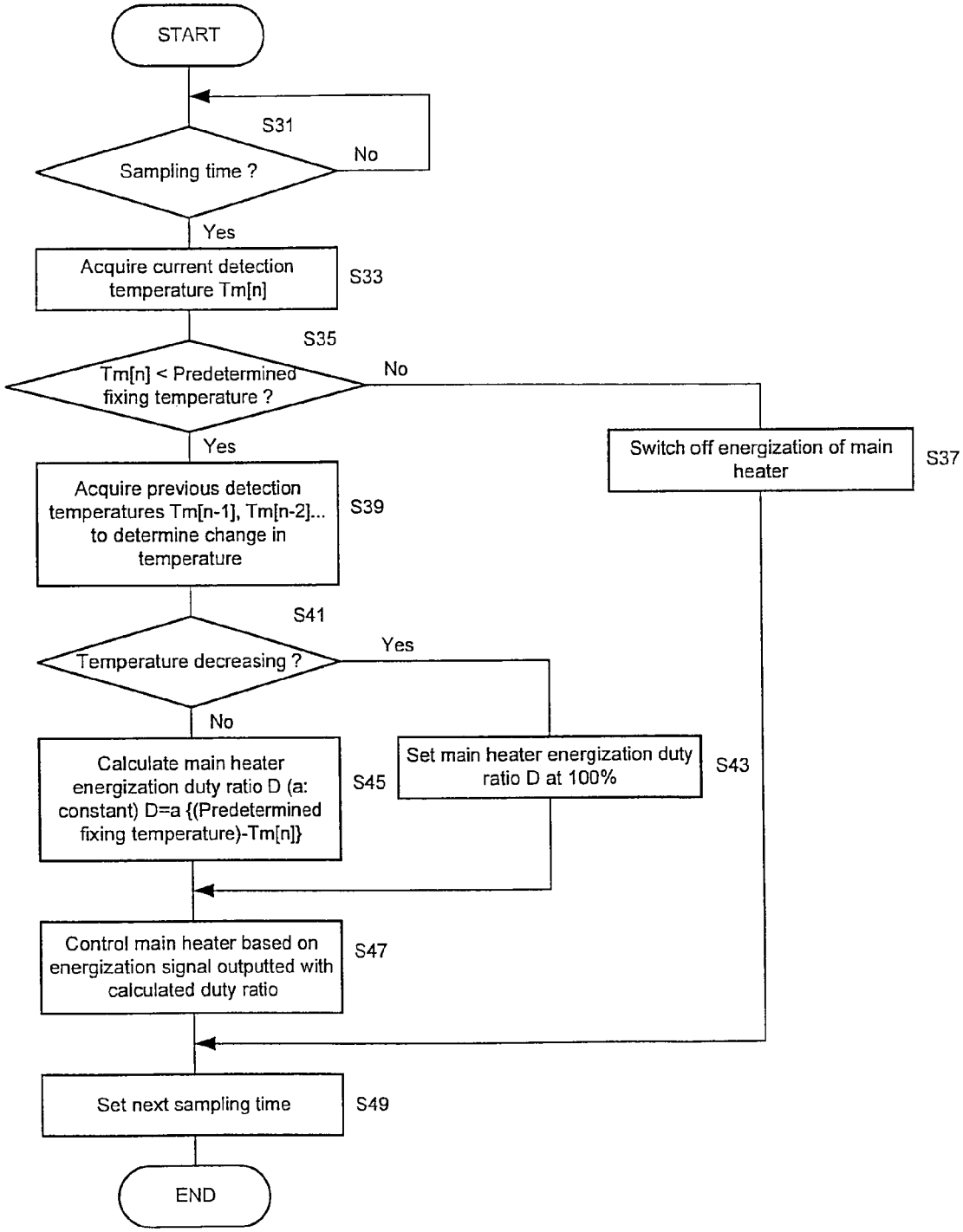
FIG. 8 is a flow chart illustrating the temperature control according to FIGS. 7A to 7D.

FIG. 8 is a flow chart illustrating the temperature control according to FIGS. 7A to 7D. Step S31 in FIG. 8 corresponds to Step S11 in FIG. 2, and Steps S35 to S43 in FIG. 8 correspond to Steps S15 to S23 in FIG. 2. Steps S47 and S49 in FIG. 8 correspond to Steps S27 and S29 in FIG. 2, respectively. Therefore, explanation will be mainly given to Steps S33 and S45 which correspond none of the steps shown in FIG. 2.

When sampling time comes (Step S31), the microprocessor acquires a current detection temperature Tm[n] (Step S33).

Then, the microprocessor judges, with reference to the previous and current detection temperatures Tm, whether the temperature is decreasing (Step S39). As in the embodiment shown in FIG. 2, the number of the previous detection temperatures to be referred to is determined so that ripples and noises occurring in a short cycle can be eliminated for accurate judgment of the change in the temperature.

If it is judged that the temperature is not decreasing, the microprocessor determines the main heater energization duty ratio from the following expression (2) (step S45):

$$D=a\times\{(\text{predetermined fixing temperature})-Tm[n]\} \quad (2)$$

wherein D is the energization duty ratio and a is a constant.

According to the expression (2), the energization duty ratio is reduced, as the detection temperature Tm[n] approaches the predetermined fixing temperature. If the detection temperature Tm[n] is equal to the predetermined fixing temperature, the energization duty ratio is set at 0%, i.e., the energization is switched off.

However, the expression on which the determination of the energization duty ratio is based is not limited to the expression (2). For example, the energization duty ratio may be determined further based on a change in a difference between the predetermined fixing temperature and the detection temperature Tm[n]. Alternatively, the determination of the energization duty ratio may be based on a quadratic expression of the predetermined fixing temperature and the detection temperature Tm[n], or may be based on a data table which cannot be represented by a simple arithmetic expression as in the embodiment according to FIGS. 1A to 1E.

The microprocessor controls the energization of the main heater 83 with the energization duty ratio determined from the expression (2) (Step S47).

Obviously, various modifications of the present invention are possible in addition to the embodiments described above. It should be understood that such modifications also fall within the aspects and scope of the present invention. The present invention is intended to embrace all alterations made within the scope of the invention defined by the appended claims and their equivalents.

What is claimed is:

1. A fuser apparatus comprising:

a fuser member having an endless contact surface to be brought into contact with each of successively transported recording media and a non-contact surface so as not to be brought into contact with the recording medium, the fuser member being arranged to apply heat to the recording medium from the contact surface to fix a toner on the recording medium;

a heating member which is energized to supply heat to the contact surface;

a contact surface temperature detecting member for detecting a temperature of the contact surface;

a non-contact surface temperature detecting member for detecting a temperature of the non-contact surface which is increased by heat conduction from the contact surface; and an energization controlling member for controling energization power of the heating member;

wherein, when the contact surface temperature rises toward a predetermined temperature, the energization controlling member controls the heating member energization power so that the heating member energization power is reduced as a difference between the non-contact surface temperature and the contact surface temperature decreases.

2. A fuser apparatus according to claim 1, wherein the energization controlling member controls the energization power by turning on and off energization of the heating member and varying a ratio between an on-period and an off-period.

3. A fuser apparatus according to claim 1, wherein the fuser member is a fuser roller.

4. A fuser apparatus according to claim 1, wherein the heating member is a heater disposed in generally center portion of an axis of a fuser roller serving as the fuser member.

5. A fuser apparatus according to claim 1, wherein the fuser member is a fuser roller which has a peripheral surface having a greater width than a width of the recording medium in the axis direction, the contact surface is a generally axially middle portion of the peripheral surface to be brought into contact with the recording medium, and the contact surface temperature detecting member is at least partly disposed in opposed relation to or in contact with the contact surface.

6. A fuser apparatus according to claim 1, wherein the fuser member is a fuser roller which has a peripheral surface having an axial length greater than a width of the recording medium, the non-contact surface is a portion of the peripheral surface excluding a generally axially middle portion of the peripheral surface to be brought into contact with the recording medium, and the non-contact surface temperature detecting member is at least partly disposed in opposed relation to or in contact with the non-contact surface.

7. A fuser apparatus according to claim 6, wherein the contact surface temperature detecting member is disposed in opposed relation to the contact surface, and the non-contact surface temperature detecting member is disposed in contact with the non-contact surface.

8. An image forming apparatus comprising a fuser apparatus as recited in claim 1.

9. An image forming apparatus comprising a fuser apparatus as recited in claim 2.

10. An image forming apparatus comprising a fuser apparatus as recited in claim 3.

11. An image forming apparatus comprising a fuser apparatus as recited in claim 4.

12. An image forming apparatus comprising a fuser apparatus as recited in claim 5.

13. An image forming apparatus comprising a fuser apparatus as recited in claim 6.

14. An image forming apparatus comprising a fuser apparatus as recited in claim 7.

15. A fuser apparatus comprising:

a fuser member having an endless contact surface to be brought into contact with each of successively transported recording media for applying heat to the recording medium from the contact surface to fix a toner on the recording medium;

a heating member which is energized to heat the fuser member to supply heat to the contact surface;

a contact surface temperature detecting member for detecting a temperature of the contact surface; and an energization controlling member which controls energization power of the heating member so that the detected contact surface temperature is equal to a predetermined temperature;

wherein, when an amount of the heat supplied to the contact surface from the heating member is greater than an amount of the heat applied to the recording medium from the contact surface to increase the contact surface temperature toward the predetermined temperature, the energization controlling member controls the heating member energization power so that the heating member energization power is reduced as a difference between the predetermined temperature and the contact surface temperature decreases.

16. A fuser controlling method comprising:

using a fuser member having an endless contact surface to be brought into contact with each of successively transported recording media and a non-contact surface so as not to be brought into contact with the recording medium to apply heat to the recording medium from the contact surface to fix a toner on the recording medium;

energizing a heating member to heat the fuser member to supply heat to the contact surface;

detecting a temperature of the contact surface by a contact surface temperature detecting member;

detecting a temperature of the non-contact surface by a non-contact surface temperature detecting member, the non-contact surface temperature being increased by heat conduction from the contact surface; and controlling energization power of the heating member by an energization controlling member so that the detected contact surface temperature is equal to a predetermined temperature;

wherein, when an amount of the heat supplied to the contact surface from the heating member is greater than an amount of the heat applied to the recording medium from the contact surface to increase the contact surface temperature toward the predetermined temperature, the heating member energization power is controlled so as to be reduced as a difference between the non-contact surface temperature and the contact surface temperature decreases.

* * * * *